United States Patent [19]

Liedes et al.

[11] Patent Number: 4,923,567

[45] Date of Patent: May 8, 1990

[54] GUIDING AN END CONDUCTION STRIP OF A WEB FORWARDLY FROM A ROLL

[75] Inventors: Allan Liedes, Palokka; Heikki Ilvespää; Olavi Viitanen, both of Jyväskylä, all of Finland

[73] Assignee: Valmet Paper Machinery Inc, Finland

[21] Appl. No.: 295,292

[22] Filed: Jan. 10, 1989

[30] Foreign Application Priority Data

Jan. 26, 1988 [FI] Finland ..... 880350

[51] Int. Cl.[5] ..... D21F 7/00

[52] U.S. Cl. ..... 162/193; 34/120; 162/194; 162/286; 162/360.1; 226/7; 226/97

[58] Field of Search ..... 162/193, 194, 195, 283, 162/360.1, 286; 226/7, 97; 34/117, 120

[56] References Cited

U.S. PATENT DOCUMENTS

| | | | |
|---|---|---|---|
| 1,279,756 | 9/1918 | Pope | 162/193 |
| 1,338,094 | 4/1920 | Pope | 162/193 |
| 1,595,478 | 8/1926 | Minton | 34/117 |
| 1,687,847 | 10/1928 | Read | 162/193 |
| 3,096,233 | 7/1963 | Rappaport et al. | 162/193 |
| 3,999,696 | 12/1976 | Reba et al. | 226/97 |
| 4,014,487 | 3/1977 | Reba et al. | 226/97 |
| 4,136,808 | 1/1979 | Reba | 226/97 |
| 4,147,287 | 3/1979 | Reba | 226/97 |
| 4,684,443 | 8/1987 | Kerttula et al. | 162/193 |
| 4,726,502 | 2/1988 | Cryderman | 162/193 |

FOREIGN PATENT DOCUMENTS 78943 6/1989 Finland .

*Primary Examiner*—Karen M. Hastings
*Attorney, Agent, or Firm*—Steinberg & Raskin

[57] ABSTRACT

Method and apparatus for guiding and directing an end conduction strip of a web from a smooth-surfaced roll, such as a paper web in a press. The end conduction strip is detached from the smooth surface of the roll and further guided by utilizing a guide plate and air blowing actions. An air jet having sufficiently great impulse is directed against the end conduction strip on the roll surface. The end conduction strip is cut with the aid of this air jet and a leading edge thereof is detached by this air jet from the roll surface. The detached end conduction strip is further guided and conveyed forwardly by a transfer blowing action. This transfer blowing action is directed along the guide plate. An under-pressure field is produced in conjunction with the guide plate, by effect of the blowing action. The effect of this under-pressure field causes the end conduction strip to be further guided in a direction determined by the guide plate.

29 Claims, 3 Drawing Sheets

GUIDING AN END CONDUCTION STRIP OF A WEB FORWARDLY FROM A ROLL

BACKGROUND OF THE INVENTION

The present invention concerns a procedure for guiding an end conduction or lead-in strip of a paper web from a smooth-surfaced roll or equivalent in a press section, and directing the end conduction or lead-in strip to the desired location, e.g. to a start of a drying section following the press section. In this procedure, the end conduction or lead-in strip is detached from the smooth surface of the roll and is guided forwardly, by making use of a guide plate and of gas or air blowing actions.

Additionally, the present invention also concerns means for implementing the above-noted procedure of the present invention, such means being disposed in a vicinity of the paper machine press roll or equivalent, and comprising blowing members which have been connected to a blowing air source and from which blowing actions guiding the end conduction or lead-in strip can be directed, these blowing members being provided with nozzles.

The procedure and means of the present invention are intended for use at such points in a paper machine where the end conduction of the web is carried out by cutting from a margin of a full-width web, a narrow band, e.g. 150 to 500 mm in width, or a so-called end conduction or lead-in strip which is driven forwardly with the aid of air jets and various guide plates. Such points are, for instance, those points where the web is transferred from a smooth-surfaced central roll of the press to the drying section.

The technique most commonly applied by Valmet at present for end conduction strip transfer in a press section, is the blowing of compressed air with a perforated nozzle tube against a roll surface of a central roll or a smooth roll of a fourth press nip. When separation of the end conduction strip from the roll has been accomplished, the strip is guided with a slight rotation of the tube into a throat defined by a first drying cylinder and a drying wire. This action presents great difficulties, especially at high running speeds, and requires great skill of an operator. Additionally, an operator performing this task has to work under conditions which are unsatisfactory regarding labor safety.

SUMMARY OF THE INVENTION

Accordingly, it is an object of the present invention to provide new procedure and means in which the above-noted drawbacks can be largely eliminated.

It is also an object of the present invention to improve the cutting and guiding of a lead-in or end conduction strip of a web, such as a paper web from a press section to a drying section in a paper machine.

It is another object of the present invention to provide margin strip guiding and cutting means which do not require moving parts and cutting blades.

It is a further object of the present invention to provide procedure and means which can be disposed to be controllable from an operating desk of a paper machine so that it is not necessary in conjunction with end conduction to approach, e.g. the immediate vicinity of the press, whereby labor safety is also improved.

These and other objects are attained by the present invention which is directed to a method for guiding an end conduction strip from a roll and aiming the end conduction strip towards a desired location, which comprises the combination of steps of directing a gas jet having sufficient impulse and sharpness against the end conduction strip on the roll surface, whereby the end conduction strip is detached from the roll surface, and directing a transfer blowing action along a guide plate to generate an under-pressure field in conjunction with the guide plate, whereby the thus-detached end conduction strip is guided in a direction determined by the guide plate. The end conduction strip may also be cut off from a remainder of a web with the gas jet, which detaches a leading edge of the strip off the roll surface. Preferably, the smooth-surfaced roll is in a press section of a paper machine, and the desired location is a drying section following the press section.

The present invention is also directed to apparatus for guiding an end conduction strip from a roll and towards a desired location, which comprises the combination of a first blow nozzle arrangement for directing a gas jet at a surface of a roll from which the end conduction strip is being detached, substantially against the roll surface, a second blow nozzle arrangement for directing a transfer blowing action to guide the end conduction strip to the desired location after detachment off the roll, and a guide plate oriented to commence substantially adjacent to the second blow nozzle arrangement and extend substantially in a direction the end conduction strip is to be guided from the roll surface. The first blow nozzle arrangement is preferably situated to direct the gas jet substantially perpendicularly to a tangent of the roll surface.

The roll is preferably a smooth-surfaced paper machine press roll, with each nozzle arrangement forming part of a respective blowing member coupled to a source of gas and provided with a respective blow tube or blow box. Preferably, the second nozzle arrangement is oriented to direct the transfer blowing action, at least to some extent, against a direction in which the end condution strip arrives from the roll. The guide plate preferably extends at an acute angle with respect to a tangent to the roll surface at a detaching point of the strip off the roll surface.

Therefore, in order to attain the objects described above and others which will become apparent below, the procedure of the present invention is principally characterized by comprising the following steps, in combination:

(a) An air jet having sufficient impulse and sharpness is directed against an end conduction strip on a roll surface;

(b) The end conduction strip is cut off by the air jet, and its end on an incoming side is detached from the roll surface with the aid of this jet;

(c) The end conduction strip detached in the preceding step (b) is further guided and transported by transfer blowing; and (d) The transfer blowing is directed along a guide plate or equivalent, and produces, in conjunction with the guide plate, an under-pressure field by the effect of which the end conduction strip is further guided in the direction determined by the guide plate.

The means of the present invention are, in turn, principally characterized by comprising the combination of:

(a) A first blow tube or box provided with a blowing nozzle arrangement which is directed substantially at right angles against that roll surface from which the end conduction strip is being detached;

(b) A second blow tube or box provided with a blowing nozzle arrangement which is directed, at least to some extent, against an incoming direction of the end conduction strip; and (c) A guide plate commencing adjacent to the blowing nozzle of the second blow tube or box and extending in the propagation direction of the lead or end conduction strip at an acute angle with respect to a tangent plane situated at a detaching point of the lead strip against the roll surface.

With the aid of the procedure and means of the present invention, the end conduction or lead strip can be cut off with air jets having a sufficient impulse, while simultaneously the strip can be immediately detached from the surface of the central roll or equivalent. Subsequent to this cutting and detachment step, the end of the end conduction strip is immediately further guided and transported, this being accomplished with transfer blows in conjunction with the guide plate.

In an especially advantageous embodiment of the present invention, it is also an essential feature that the forward transporting direction of the end conduction or lead strip after detaching from the roll surface, subtends an acute angle with the direction in which the strip arrives at the point of detachment, which contributes to stable further guiding of the end conduction strip and to the accurate aiming of the strip at a desired target.

BRIEF DESCRIPTION OF THE DRAWINGS

The present invention is described below in greater detail, with reference to certain exemplary embodiments thereof presented in the accompanying figures, and to which details the present invention is not intended to be confined. In the drawings.

DESCRIPTION OF THE PREFERRED EMBODIMENTS

Two typical application environments of the procedure and means of the present invention will first be described with reference to FIGS. 1 and 2.

Figure 1:
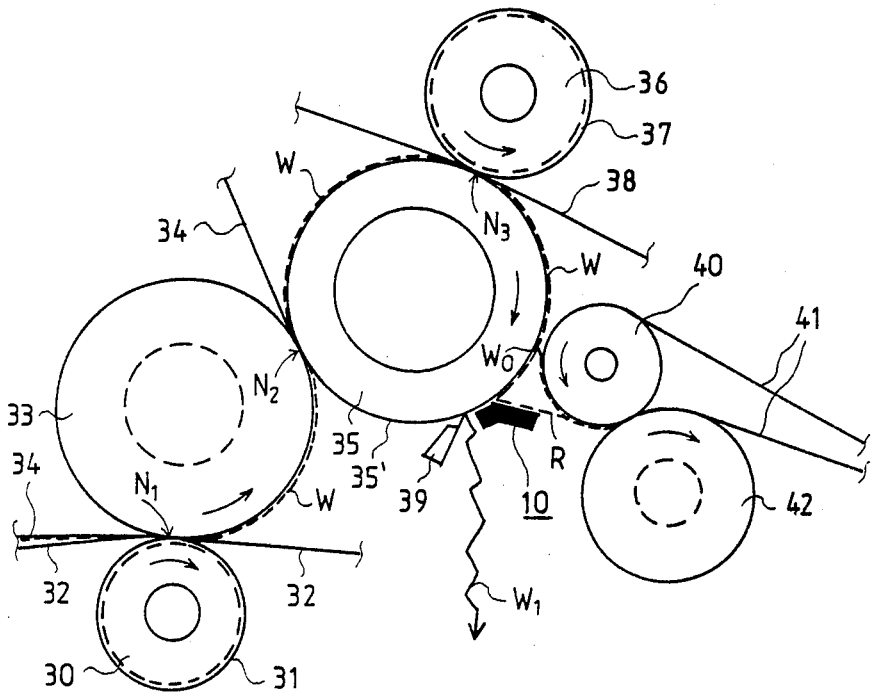
FIG. 1 illustrates a schematic elevational view of a typical application area of the present invention, i.e., a closed press section of a paper machine.

As illustrated in FIG. 1, end conduction strip guiding means 10 of the present invention have been situated in conjunction with a smooth-surfaced central roll 35 of a closed press section, on a lower sector thereof before a doctor blade 39. The press section illustrated in FIG. 1 is, in all other respects, the Sym-Press II (TM) press section of Valmet, known in the art, to which the web W to be pressed is now carried with a pick-up felt 34 serving as a press fabric in first and second nips $N_1$ and $N_2$.

The first nip $N_1$ is a two-felt nip and is defined between a suction roll 33 and a roll 30 having a recessed surface 31. The web separates from the lower felt 32, following along with the pick-up felt 34 and the surface of the suction roll 33 to the second nip $N_2$, where the web W is detached from the felt 34 and is transferred onto the smooth surface 35' of a central roll 35 such as a stone roll, on which the web W moves to a third nip $N_3$ provided with a felt 38. This third nip $N_3$ is defined between a press roll 36 having a recessed surface 37 and the central roll 35. The full-width web W is detached in a free draw $W_0$ and transferred to a drying wire 41 passing over a guide roll 40. This wire 41 guides the web W on its underside over a roll 42 to a drying section (not illustrated).

The means 10 of the present invention have been placed in conjunction with a second lower quadrant of the central roll 35 before the doctor blade 39 and on a level of a transfer nip defined by the rolls 40 and 42 or equivalent.

Figure 2:
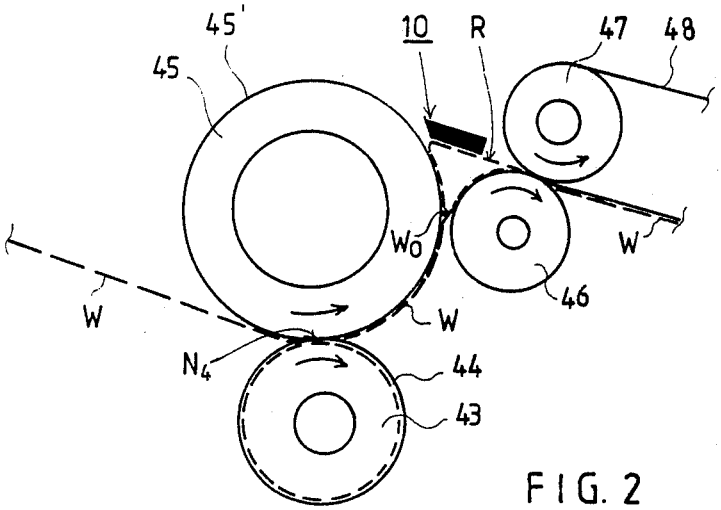
FIG. 2 illustrates, in a manner similar to FIG. 1, another application area of the present invention, namely a separate press nip which may operate, for instance, after the closed press section depicted in FIG. 1.

The guiding means 10 of the present invention for the end conduction or lead strip R which is cut from a side of the full-width W, may also be applied in association with a separate press nip $N_4$ illustrated in FIG. 2. The press nip $N_4$ is defined between a lower press roll 43 having a recessed surface 44 and an upper press roll 45 having a smooth surface 45'. The full-width web W is detached as a free draw $W_0$, transferred over a guide roll 46 to a drying wire 48 passing over a roll 47 and on the underside of the latter wire 48, and further onto a drying section. The means 10 of the present invention have been situated on an upper sector of the upper roll 45 and on a level of a transfer nip defined by the rolls 46 and 47, or close to this level.

An advantageous structural and functional example of the guide means 10 described above will be described below, with reference being made primarily to FIGS. 3 and 4.

Figure 5:
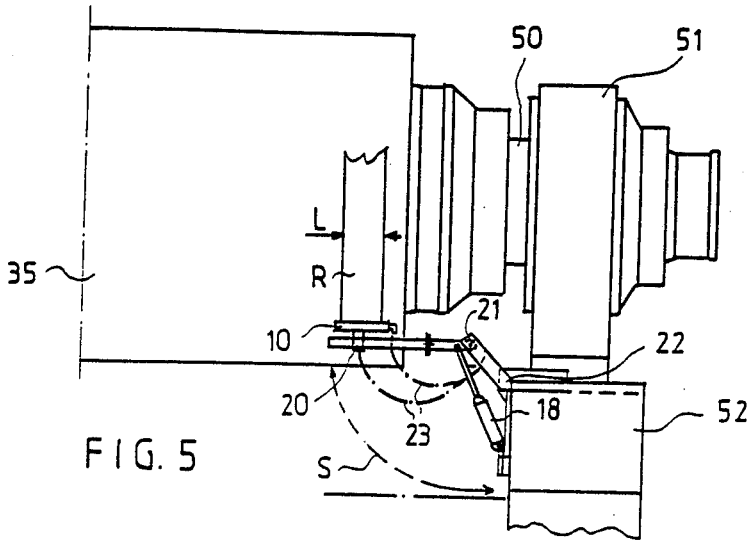
FIG. 5 illustrates placement of means in accordance with the present invention in conjunction with a smooth-surfaced central roll of a paper machine press.

The means 10 of the present invention comprise a blow box 11 disposed adjacent to the shell 35' of the roll 35, and spaced therefrom at a small distance. The blow box extends in a cross-machine direction at least over the entire width L of the end conduction strip R (FIG. 5). The wall of the blow box 11 is provided with a set of nozzle apertures or with an equivalent nozzle slot 12. A blow tube 41 is disposed adjacent to the blow box 11. Nozzle apertures 15 or an equivalent slit nozzle open from the blow tube 14 and are directed against the smooth surface 35' of the roll 35. A guide plate 16 is provided adjacent to a wall of the blow box 11 facing the nozzle apertures 12 and spaced therefrom by a narrow gap 17. The guide plate 16 features an upwardly slanting section 16R commencing at the nozzle gap 17 and having a fairly large radius of curvature $R_0$, followed by a planar portion 16T.

Figure 7:
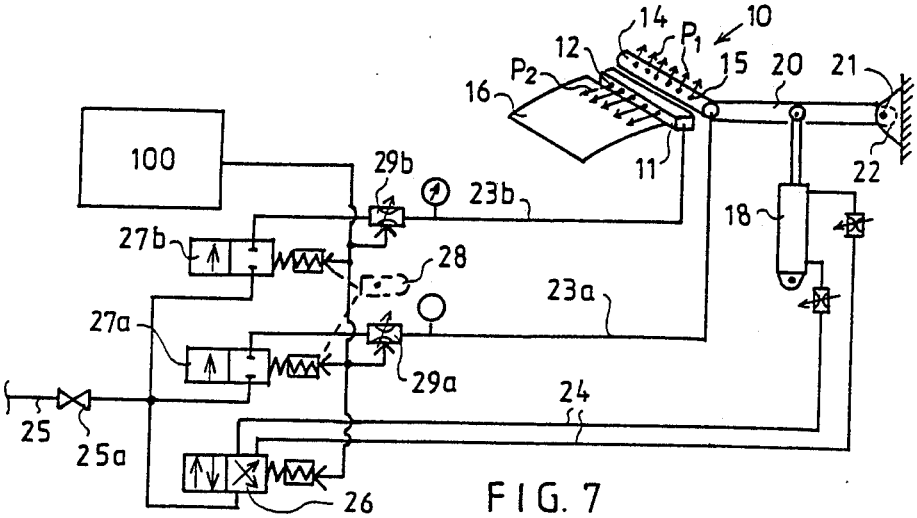
FIG. 7 is a schematic illustration of a pneumatic control system associated with the means of the present invention.

The placement of the means 10 of the present invention in conjunction with the central roll 35 of a press section or with another equivalent press roll 45, is illustrated in FIGS. 5 and 7. A cantilever beam 22 has been disposed adjacent to support beams 52 of bearing housing 51 for journal pins 50 of the central roll 35, with an arm 20 being attached by a pivot axle 21 to the cantilever beam 22. The blow box 11 and the blow tube 14 of the means 10 of the present invention have been mounted on the arm 20, to which compressed air tubes 23 lead from a compressed air system illustrated in FIG.

7. The means 10 are turnable and are carried on the arm 20 about the pivot axle 21 by means of a power cylinder 18 through an arc indicted by arrow S, so that the means 10 will not interfere with any other operation after the end conduction has been completed Similarly, the means 10 can be extended out into operating position by remote control from a central control room of a paper machine, to initiate the end conduction process.

A pneumatic system associated with the present invention is illustrated in FIG. 7, where compressed air is supplied to such system by input pipe 25 which includes a control and/or shut-off valve 25*a* if such is required. The operation of the power cylinder 18 is controlled by a valve 26 in pipe 24. Pipes 23*a* and 23*b* branch off from the compressed air supply pipe 25, through valves 27*a* and 27*b* to the blow box 11 and the blow tube 14. Throttling means or pressure controllers 29*a*, 29*b* have been inserted in the pipes 23*a* and 23*b*, by means of which pressures $p_2$ and $p_l$ in the box 11 and the tube 14 can be regulated. The control system is schematically illustrated in FIG. 7 as a block 100, with which the various functions of the means 10 of the present invention are controlled, most appropritely from the central control room of the paper machine.

The functional steps of the procedure and the means 10 of the present invention in various situations are described below with reference to all of FIGS. 1–7. Prior to end conduction, a full-width paper web W is detached by the doctor blade 39 and guided as a run $W_1$ to a pulper provided below (not illustrated). The end conduction is started, either automatically under control of the control unit 100 or by a control pulse from a control switch manipulated by an operator. Thereby, the power cylinder 18 is pressurized and turns the arm 20 about the pivot 21 so that the means 10 assume the operating position depicted in FIGS. 3, 4, and 5.

From one side of the web W, a narrow lead strip R is cut with a spray cross cutter (tail cutter/diagonal cutter) known in the art (not illustrated). The spray cross cutter means an air jet or water device by which a web can be cut. At first, a narrow lead strip R is cut, and when its run is stabilized, the spray cross cutter is traversed in the cross-direction of the web, and the lead strip R is thus widened to be of full-width. This spray cross cutter has already been in use for quite some time.

Figure 6:
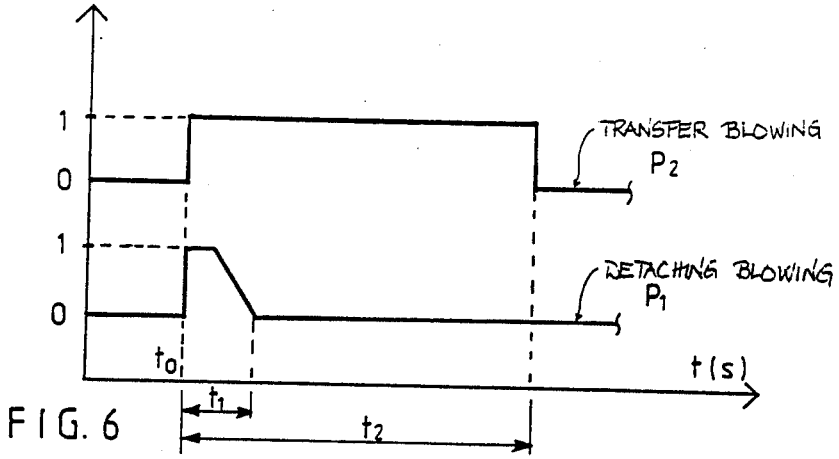
FIG. 6 is a graphic illustration of mutual phasing and timing of various blowing actions applied in the means of the present invention.

At the time $T_0$ indicated in FIG. 6, the valves 27*a* and 27*b* open and admit compressed air into the blow box 11 and the blow tube 14. A powerful and sharp detaching blow $P_1$ is directed from the blow tube 14 with rather high pressure $p_1$, this jet cross-cutting the end conduction strip R and at the same time detaching it from the smooth surface 35' of the roll 35, to which the strip R is rather strongly adherent. The blowing angle of the blow action $P_1$ can be controlled to suit the running conditions, etc.

Figure 3:
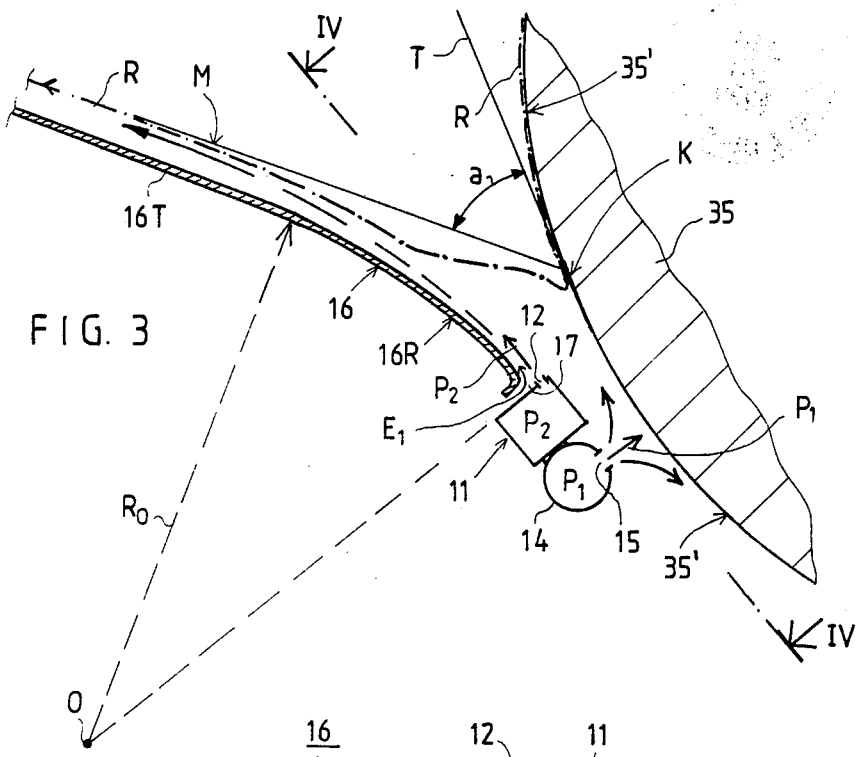
FIG. 3 illustrates a vertical sectional view in a machine direction of end conduction means of the present invention as applied in the environment of FIG. 1.
Figure 4:
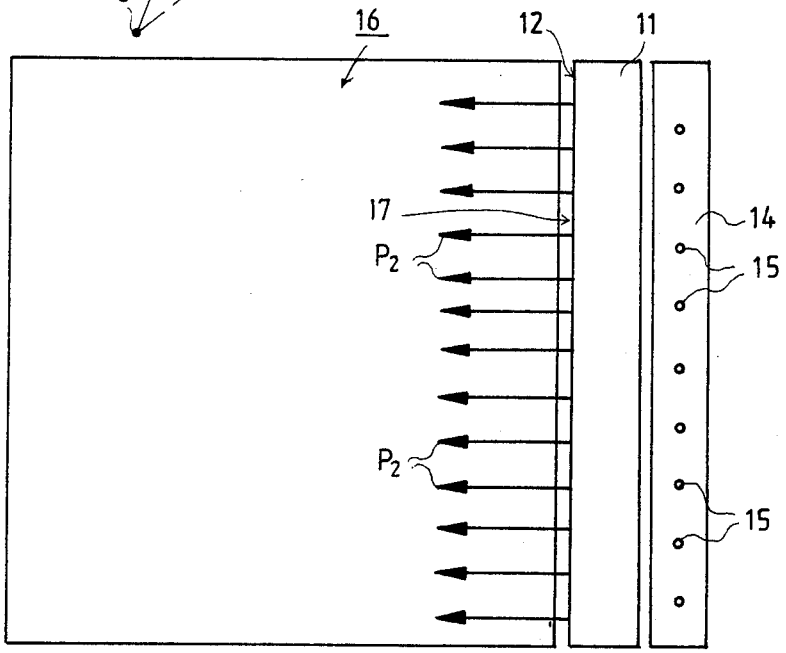
FIG. 4 is a view along line IV—IV of FIG. 3.

After the end of the end conduction or lead strip R has been detached from the surface 35' of the roll 35, it immediately enters the action area of the curved initial section 16R of the guide plate 16, where the transfer blows $P_2$ guide the strip R in the manner illustrated in FIG. 3, for instance into a throat defined by a first drying cylinder and the drying wire 41, into a rope throat or, alternatively, from a third to a fourth press.

Air is blown at high velocity in the direction of the plate 16 through the blow nozzle 12 of the blow box 11 facing the guide plate 16, whereby an under-pressure field is produced by the action of which the running of the end conduction strip R becomes stabilized so that it is guided by the plate 16 without contact and assumes a direction determined by the planar portion 16T of the plate 16. When the initial part 16R of the plate 16 is formed to have a suitable, fairly large radius of curvature $R_0$, the strip R is swiftly stabilized to be governed by effect of the transfer blow $P_2$ and the guidance of the plate 16, and it is pulled taut so as to prevent bagging between the press roll 35 and said means 10.

The guide plate 16 and the blow box 11 define a narrow gap space 17 through which air is ejected in the direction of arrow $E_1$ to join the blow jets $P_2$ which promotes the stable operation of the means 10.

As can be seen in FIG. 6, the detaching blow $P_1$ is only on during a comparatively short period of time $t_1$ starting from the beginning time $t_0$, after which the valve 27*a* closes under control by the control unit 100 and/or a timer 28. As illustrated in FIG. 6, the transfer blow $P_2$ is on during a time period $t_2$, its length being selected to be sufficient so that the running of the end conduction strip R can be stabilized. The operation of the valves 27*a* and 27*b* can either be controlled by means of a separate timing unit 28 or the respective function can be located in the central unit 100.

An important feature for the placement and operation of the means 10 of the invention, is that the initial direction M of the end conduction strip R in the means 10 is at an acute angle in relation to the entrance direction T of the end conduction strip R, i.e. a tangential plane T of the roll 35 at a detaching point K. Thus, the detaching force which the strip requires is at a minimum. The size of this angle a is, as a rule, in the range a=about 5°–60°, most advantageously in the range a=about 10°–40°. In this manner, the strip R can be efficiently detached from the smooth surface 35' of the roll 35 to which the strip is quite firmly adherent, while with the aid of the blowing actions $P_2$ efficient guiding entrainment of the end of the strip R is achieved which can be aimed at the desired goal or location.

The blow actions $P_1$ and $P_2$ are arranged to be as close together as possible so that the cutting/detaching blow $P_1$ and the guiding blow $P_2$ act on the same side of the strip R, i.e. on that side which was situated against the surface 35' of the roll 35. Usually, no angulations are required on the guide plate 16. After the guide plate 16, additional guide plates known in and of themselves in the prior art, may be utilized. In the procedure, the detaching/cutting air jet $P_1$ and the transfer blow actions $P_2$ are connected to operate substantially simultaneously, with the detaching/cutting jet $P_1$ then being discontinued and the transfer blow actions $P_2$ being maintained operative for such a period $t_2$ that the running of the end conduction strip R is stabilized.

The radius of curvature $R_0$ of the initial part 16R of the guide plate 16 is usually in the range $R_0$=about 100–500 mm, most appropriately $R_0$=about 200 mm., while the center of curvature 0 is located on a side of the plate 16 opposite to that side on which the end conduction strip R arrives and leaves. It is important in view of the operation of the means 10 that the pressures $p_1$ and $p_2$ are appropriate selected. As a rule, $p_1 > p_2$. The range of the pressure $p_1$ is usually about 4–6 bar, and $p_2$=about 2–3 bar. The impulse of the blow action $P_1$ has to be sufficiently high so that the somewhat wet strip will positively break and its end will be guided with the aid of the blowing $P_1$ into contiguity with the plate 16 for further guidance by the blowing actions $P_2$.

Air is ejected (arrow $E_1$) through the gap 12 between the plate 16 and the blow box 11 and into the region of the plate 16 and the nozzle 12, so that the strip R cannot adhere to the plate 16.

The length of the plate 16, in the direction of travel of the strip R, is usually about 150–500 mm., most suitably about 200–300 mm. A characteristic of the orientation of the plate 16 is that it determines the direction of propagation of the end conduction strip R and its further aiming.

In the embodiment examples presented above, the application environment of the present invention is a press section of a paper machine. As has been initially observed, the present invention may, in special cases, also be applied elsewhere, e.g. in calenders or in other paper after-processing apparatus, although it is believed that the present invention is most suited for use in a press section where strength of the web has not yet fully developed and the web can be advantageously severed and guided onwardly with the blow actions $P_1$, $P_2$ in the manner taught by the invention herein.

Details of the present invention may easily vary within the scope of the inventive concepts set forth above, which have been presented by way of example only. Therefore, the preceding description of the present invention is merely exemplary, and is not intended to limit the scope thereof in any way.

What is claimed is:

1. Method for guiding an end conduction strip from a roll and aiming the end conduction strip towards a desired location, comprising the combination of steps of directing a first gas jet having sufficient impulse and sharpness against the end conduction strip on a surface of the roll, whereby the end conduction strip is detached from the roll surface, cutting off the end conduction strip from a remainder of a web with the first gas jet and detaching a leading edge of said strip off the roll surface, and directing a second transfer blowing action along a guide plate to generate an under-pressure field in conjunction with the guide plate, whereby the thus-detached end conduction strip is guided in a direction determined by the guide plate, wherein the first gas jet is directed against the surface at substantially right angles to a tangent thereof, and at a location after the detaching point of the end conduction strip off the roll surface, orienting said second transfer blowing action, at least to some extent, against a direction in which the end conduction strip arrives from the roll, directing the first gas jet and the second transfer blowing action both from the same side of a web being led by the end conduction strip, and directing the first gas jet and the second transfer blowing action to be initially substantially perpendicular to one another in a radial plane of the roll.

2. The combination of claim 1, wherein the roll is a smooth-surfaced roll in a press section of a paper machine and the desired location is a drying section following the press section.

3. The combination of claim 2, wherein said press section is formed by four rolls arranged to define three press nips, a first nip in a direction of web run being defined between a suction roll and a recessed surface roll, a second nip in the web run direction being defined between the suction roll and a central roll, and a third nip in the web run direction being defined between said central roll and a recessed surface roll, said four rolls being arranged with respect to one another such that the web is always supported on a surface of said suction roll or central roll between said three respective nips with said press section thereby being closed, and wherein the smooth-surfaced roll is said central roll of the press section which is closed.

4. The combination of claim 2, wherein the press section comprises four press nips, and the end conduction strip is detached from the roll after the fourth press nip.

5. The combination of claim 1, additionally comprising a press section constituted by a series of rolls defining three press nips, with the web always being supported on one of the rolls from a first one to a last one of said three press nips in a direction of web run, whereby said press section is closed, and wherein the roll from which the end conduction strip is guided forms a press nip separate from said closed press section in a paper machine, and the end conduction strip is detached after the separate press nip.

6. The combination of claim 1, comprising the additional step of guiding the thus-detached end conduction strip at an acute angle with respect to a tangent of the roll at the detaching point of the strip off the roll.

7. The combination of claim 6, wherein the angle is in the range of about 5°–60°.

8. The combination of claim 7, wherein the angle is within the range of about 10°–40°.

9. The combination of claim 1, comprising the additional step of controlling the first detaching gas jet and the transfer blowing action with a control system from a control room of a paper machine.

10. The combination of claim 1, comprising the additional steps of operating the first detaching gas jet and second transfer blowing action substantially simultaneously, and then discontinuing the first detaching jet and maintaining said second transfer blowing action for a period to stabilize running of the end conduction strip.

11. The combination of claim 9, comprising the additional steps of moving a device for generating the first detaching jet and second transfer blowing action into operating position, and after guiding of the end conduction strip has been completed, moving the device away and into a non-operative position, whereby the device does not obstruct conveyance of a web from which the end conduction strip has been cut.

12. The combination of claim 1, wherein the first detaching jet has a greater pressure than the second transfer blowing action.

13. The combination of claim 12 wherein the first detaching jet pressure is about 4–6 bar, and the second transfer blowing action pressure is about 2–3 bar.

14. Apparatus for guiding an end conduction strip from a roll and towards a desired location, comprising the combination of a roll from which the end conduction strip is being detached, first blow nozzle means for directing a first gas jet at a surface of the roll from which the end conduction strip is being detached, substantially against the roll surface, said first blow nozzle means being situated to direct the first gas jet substantially perpendicularly to a tangent of the roll surface, second blow nozzle means for directing a second transfer blowing action to guide the end conduction strip to the desired location after detachment off the roll, and a guide plate oriented to commence substantially adjacent to said second blow nozzle means and extend substantially in a direction the end conduction strip is to be guided from the roll surface, said second blow nozzle means are oriented to direct said second transfer blowing action, at least to some extent, against a direction in which the end conduction strip arrives from the roll, said first and second blow nozzle means are situated adjacent one another on the same side of a web being led by the end conduction strip, and arranged such that said first gas jet and said second transfer blowing action issuing respectively from said first and second blow nozzle means are substantially perpendicular to one another in a radial plane of the roll.

15. The combination of claim 14, wherein the roll is a smooth-surfaced paper machine press roll, and each said nozzle means forms part of a respective blowing member coupled to a source of gas and provided with a respective blow tube or blow box.

16. The combination of claim 14, wherein said guide plate extends at an acute angle with respect to a tangent to the roll surface at a detaching point of the strip off the roll surface.

17. The combination of claim 15, additionally comprising a discrete gap formed between said blow tube or box of said second nozzle means and a leading edge of said guide plate, and through which air is ejected to join said second transfer blow action from said second nozzle means, said second transfer blow action being substantially parallel to said guide plate.

18. The combination of claim 14, wherein said guide plate comprises, in a direction extending away from said second nozzle means, an initial section having a relatively large radius of curvature at a side opposite a run of the end condution strip, and a subsequent, substantially straight section, which determines aiming of the end conduction strip towards the desired location.

19. The combination of claim 15, additionally comprising a frame component upon which each said respective blowing members are mounted, said frame component being movably disposed on an operating side of the paper machine for movement into operative position and into inoperative position in which said apparatus does not interfere with paper machine operation.

20. The combination of claim 19, wherein said frame component is a pivotally mounted arm.

21. The combination of claim 18, wherein said radius of curvature is within the range of about 100–500 mm.

22. The combination of claim 21, wherein said radius of curvature is about 200 mm.

23. The combination of claim 16, wherein said acute angle is about 5°–60°.

24. The combination of claim 23, wherein said acute angle is about 10°–40°.

25. The combination of claim 14, additionally comprising means for generating greater pressure of said first detaching gas jet than pressure of said second transfer blowing action.

26. The combination of claim 25, wherein said generating means are structured and arranged to generate a pressure of said first detaching gas jet of about 4–6 bar and of said second transfer blowing action of about 2–3 bar.

27. The combination of claim 14, wherein the length of said guide plate in said extending direction is about 150–500 mm.

28. The combination of claim 27, wherein said length is about 200–300 mm.

29. The combination of claim 15, wherein said first nozzle means comprise a blow tube, and said second nozzle means comprise a blow box.

* * * * *